US006532142B1

(12) United States Patent
Takamatsu et al.

(10) Patent No.: US 6,532,142 B1
(45) Date of Patent: Mar. 11, 2003

(54) ELECTRIFICATION PREVENTING IMPLEMENT AND ELECTRIFICATION PREVENTING METHOD

(75) Inventors: Kuniaki Takamatsu, Yamagata; Toyoko Ohara, Nara; Hideaki Kikuchi, Osaka, all of (JP)

(73) Assignees: Masaaki Imano, Hokkaido (JP); Akiko Ishi, Hokkaido (JP)

( * ) Notice: Subject to any disclaimer, the term of this patent is extended or adjusted under 35 U.S.C. 154(b) by 0 days.

(21) Appl. No.: 09/549,860

(22) Filed: Apr. 14, 2000

Related U.S. Application Data

(63) Continuation-in-part of application No. 08/792,930, filed on Jan. 21, 1997, now abandoned.

(30) Foreign Application Priority Data

May 9, 1996 (JP) ..... 8-115104
Jun. 26, 1996 (JP) ..... 8-166327

(51) Int. Cl.[7] ..... H01T 23/00
(52) U.S. Cl. ..... 361/231; 47/58.156

(58) Field of Search ..... 361/212, 216, 361/220, 225, 230, 231, 232, 233; 47/58.156; 504/187

(56) References Cited

FOREIGN PATENT DOCUMENTS

JP 01113466 * 5/1989 ..... C08L/101/00

* cited by examiner

*Primary Examiner*—Ronald W. Leja
(74) *Attorney, Agent, or Firm*—Darby & Darby

(57) ABSTRACT

An electrification preventing is disclosed in which granular and/or powdered Si or SiOx (0<x<2) which is charged with negative static electricity (negatively-ionized) is sealed in a glass container. The glass container that is placed in a body adjacent an area where the desired effect is to be achieved. In one preferred embodiment of the invention, the glass container is embedded in the ground. The glass container, such as a tube, contains a negatively charged material such as $Si/SiO_x$, the purpose of which is to interrupt stray electrical current in the body and thereby reduce positive static electricity in the environment.

7 Claims, 9 Drawing Sheets

(2 of 9 Drawing Sheet(s) Filed in Color)

ELECTRIFICATION PREVENTING IMPLEMENT AND ELECTRIFICATION PREVENTING METHOD

This patent application is a Continuation-In-Part of Application Ser. No. 08/792,930, filed Jan. 21, 1997 now abandoned.

FIELD OF THE INVENTION

The present invention relates to an electrification preventing implement and electrification preventing method for allowing stray current to flow easily under and above ground, thereby preventing electrification caused in the earth, human bodies and objects.

BACKGROUND OF THE INVENTION

"Stray current" is current that flows in the ground, or other body, from a high potential point to a low potential point through a path of relatively low resistance value. Examples of the stray current are earth current caused by a transmission steel tower and leakage current from the rails of an electrical railroad.

Such stray current also can flow in a body above ground, such as a metal vehicle body (automobile) where there is voltage leakage to the body and/or a potential difference between the vehicle body and the ground.

It is generally known that stray current flows in the atmosphere and the earth. Its intensity varies depending on changes in atomospheric potential caused by changes in weather, geographic features, and other natural conditions, and it also depends on artificial things such as electrical apparatus, railways, power cables, and so forth. Stray current is influenced by metalliferous veins, ground water arteries, and underground cables, if they are present. Ordinarily, in the ground at a height of 100 m above sea level, earth current of about 15 $\mu$A flows. Earth current of this intensity does not affect human bodies much. However, when the earth current having an intensity of 30 to 40 $\mu$A flows through human bodies, there is a strong possibility that the current can cause various hindrances to human health. Light symptoms caused by the electrification or stray current flow include stiffness in the shoulders, headache, fatigue and so forth. However, if the electrification lasts for a long time, or the charge quantity is large, the morbid symptoms become severe. In some cases, human relations are badly influenced by such poor physical conditions.

Electrification exerts a bad influence not only over human bodies, but also over plants, animals, and even inanimate objects. The bad influences can be appreciated as follows: for plants, the growth rate decreases and vitality is reduced; and for animals, the morbid symptoms appear. Though the electrostatic charge, generated by the electrification of an object, is used effectively in some cases, it may cause the following dynamic hindrances to occur: electrified objects such as powder, fibers, sheets and so forth are caught in other objects, combustible and explosive objects are ignited when static electricity is discharged, thereby inducing fires and explosions, and the electrostatic charge may cause breaking, error actions, or quality-deterioration of precision apparatus, such as semiconductor parts, and so forth.

Conventionally, as a method of inhibiting residual earth current to prevent electrification in a large area, embedment of carbon is carried out, as described below. For example, as shown in FIG. 1, for a building lot with a land area of 100 tsubo (1 tsubo=3.3 $m^2$), embedment pits 11 with a diameter (r) of 1 m and a depth (d) of 1 to 2 m are dug at intervals (p) of 5 to 10 m; 200 to 500 kg of Carbon 12 (for example, coconut shell carbon) is embedded in a pit. The carbon 12 may have a form of grains or powder, depending on the conditions of the land 13 and the building 14. The distance between the embedment pits 11 can be changed depending on the conditions of the land and the building. FIGS. 2(*a*) and 2(*b*) are sectional model views of the embedment pits 11. FIG. 2(*a*) shows pits provided on level ground. The pits shown in FIG. 2(*b*) are provided in sloping land (the building lot is an embankment). In the case of such sloping land as shown in FIG. 2(*b*), the carbon 12 is embedded in the natural ground at the same horizontal-level.

When the carbon is embedded, electric resistance is reduced as a whole, so that the stray current flows, swirling and spreading as shown in FIG. 3 (side view) and FIG. 4 (plan view). This reduces the electrification of humans, plants and animals, and objects present on the land in which the carbon is embedded, that is, reduces the static electricity on the ground. Such phenomena are observed at a height of about 3 m above sea level and stabilized.

FIG. 5 is a plan view which illustrates the application to a factory and a farm. The embedment pits 11 for embedding the carbon 12 are provided at an interval (p) of 10 m in the sites that constitute the apexes of a triangle. The quantities of the embedded carbon 12 are controlled according to the potential inclination. In the case of the potential inclination to be provided in the lateral direction as shown in FIG. 5, 200 kg of carbon 12 are embedded in the embedment pit 11 in the highest potential site, and 500 kg of carbon 12 is embedded in the embedment pit 11 in the highest potential site, and 500 kg of the carbon 12 is done in the embedment pit 11 in the lowest potential site. Between both sites, the quantities of the carbon to be embedded are determined according to a proportional distribution. Also, in the case of the potential inclination in the longitudinal direction of the drawing, the quantities of carbon to be embedded is controlled. The embedment pits 11 have a diameter of 1 to 1.2 m and a depth of 1 to 2 m. In this case also, it is desirable that the carbon 12 is embedded in the natural ground at the same horizontal level. In the case where carbon embedment is applied to a factory and a farm, the effects similar to the case of houses can be obtained.

However, when the embedment of carbon is carried out, 1 to 2 tons of carbon 12 is required for a house. For application to a factory (lot 100 tsubo, building 500 tsubo), 10 to 30 tons of carbon 12 are needed. In addition, many embedment pits 11 are to be dug. The overall amount of money including the construction cost is vast, thus making the economic burden very heavy. When carbon is sprayed on the ground surface to a thickness of about 3 to 10 cm, the effects can be obtained to some degree. However, the effect is inferior to that of underground embedment, and the duration of effect is shorter, that is, about half a year.

BRIEF SUMMARY OF THE INVENTION

The present invention was devised in view or the above situations and it is an object of the invention to provide an electrification preventing implement and a method of preventing electrification which are capable of easily reducing stray current (earth current) using relatively inexpensive means, thereby preventing a human body, a plant, an animal and an object form being electrified.

An electrification preventing device of the invention is characterized in that granular and/or powdered Si or SiOx ($0<x<2$) which is charged with negative static electricity (negatively-ionized) is sealed in a glass container. The glass container that is placed in a body adjacent an area where the desired effect is to be achieved. In one preferred embodiment of the invention, the glass container is embedded in the ground. The glass container, such as a tube, contains a negatively charged material such as $Si/SiO_x$, the purpose of which is to interrupt stray electrical current in the body and thereby reduce positive static electricity in the environment.

The relationship of the size of the coantiner, the amount of material such as $Si/SiO_x$ and other factors is relative. That is, in a case with a degree of reduction of electrification is to be high, a container, or more than one container, is used which can produce a large amount of ionization or a container of Irager size with more of the $Si/SiO_x$ is used. The size of the body in which the desired effect is to be achieves is also a factor. For example, a 20 acre plot of land, requires more and/or larger containers than a 100 square foot plot.

A method of preventing electrification according to the invention is characterized in that the electrification preventing implement is embedded underground in an upright position.

BRIEF DESCRIPTION OF THE DRAWINGS

The patent or application filed contains at least one drawing executed in color. Copies of this patent or patent application publication with colored drawings will be provided by the office upon request and payment of the necessary fee.

DETAILED DESCRIPTION OF THE PREFERRED EMBODIMENT

Hereinafter, the present invention will be described in specific terms, in reference to the drawings showing embodiments.

Figure 1:
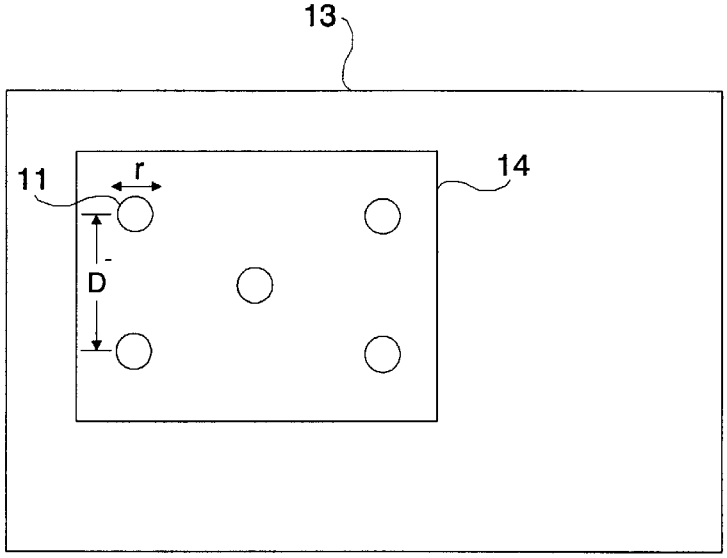
FIG. 1 PRIOR ART
FIG. 1 is a plan view showing an application of carbon embedment to a residential land.
Figure 2A:
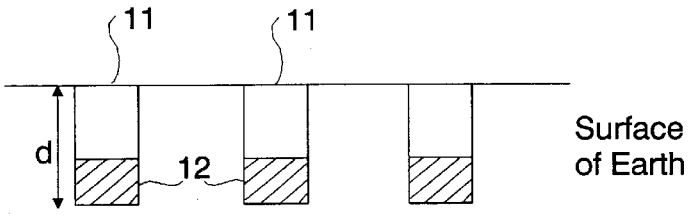
FIG. 2A PRIOR ART
FIGS. 2A and 2B are schematic sectional views showing embedment pits for carbon embedment.
Figure 2B:
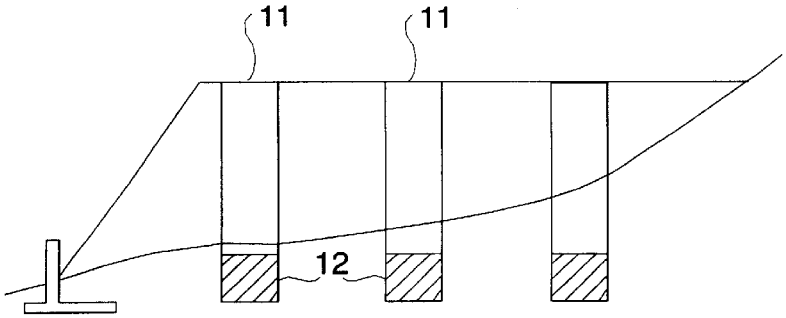
FIG. 2B PRIOR ART
Figure 3:
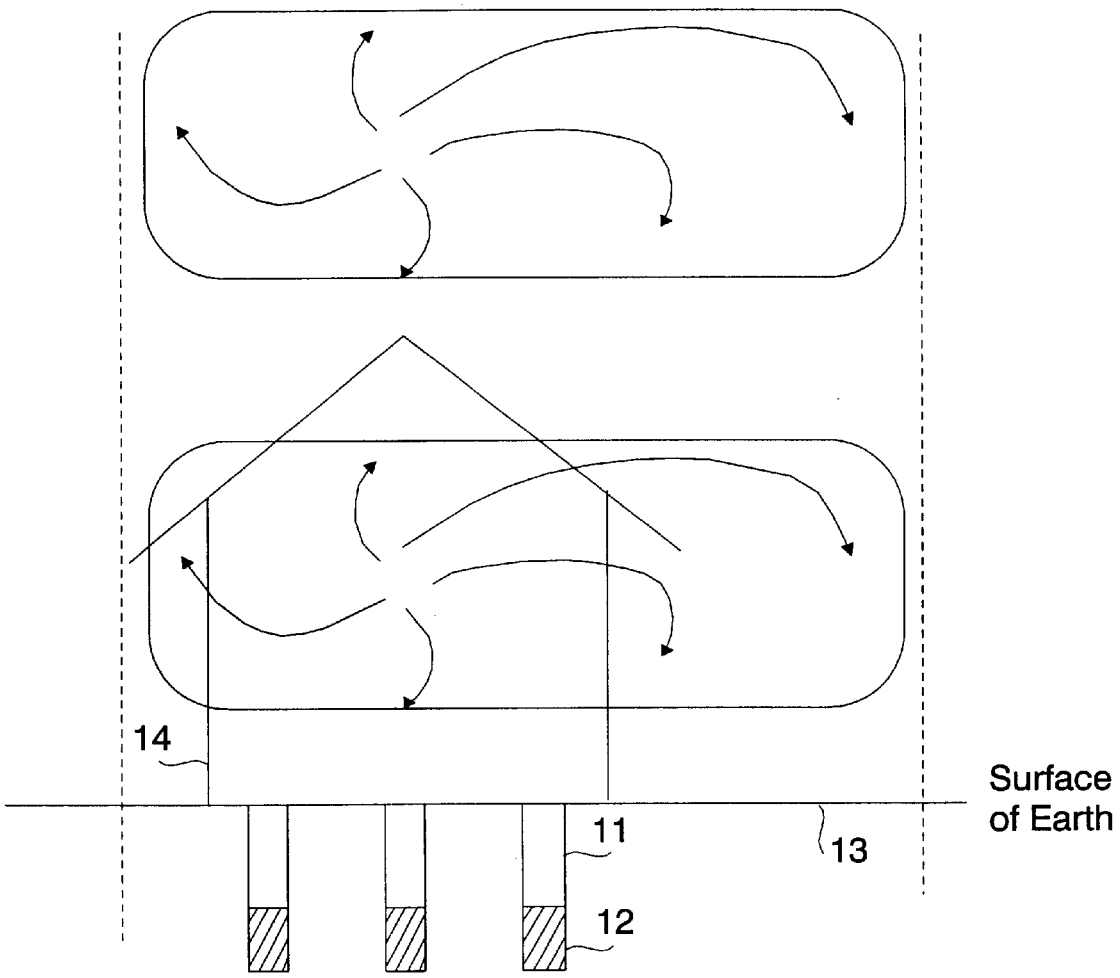
FIG. 3 PRIOR ART
FIG. 3 is a side view showing stray current in an application of carbon embedment.
Figure 4:
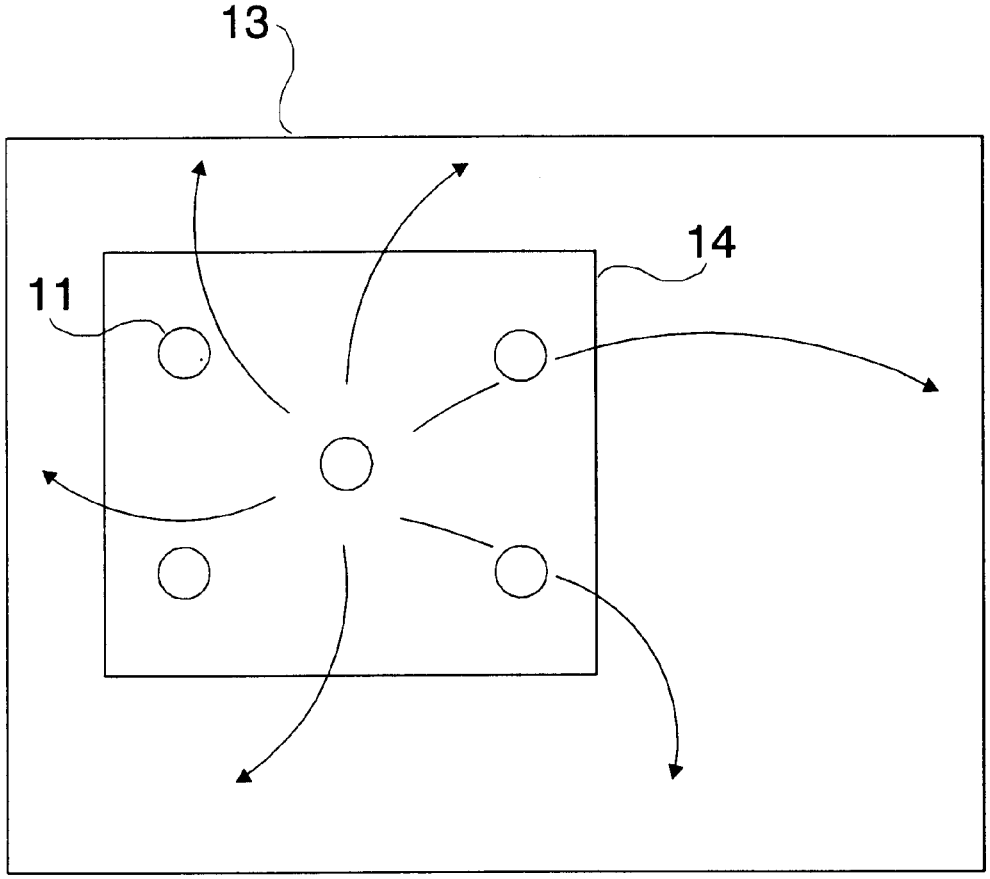
FIG. 4 PRIOR ART
FIG. 4 is a plan view showing stray current in an application of carbon embedment.
Figure 5:
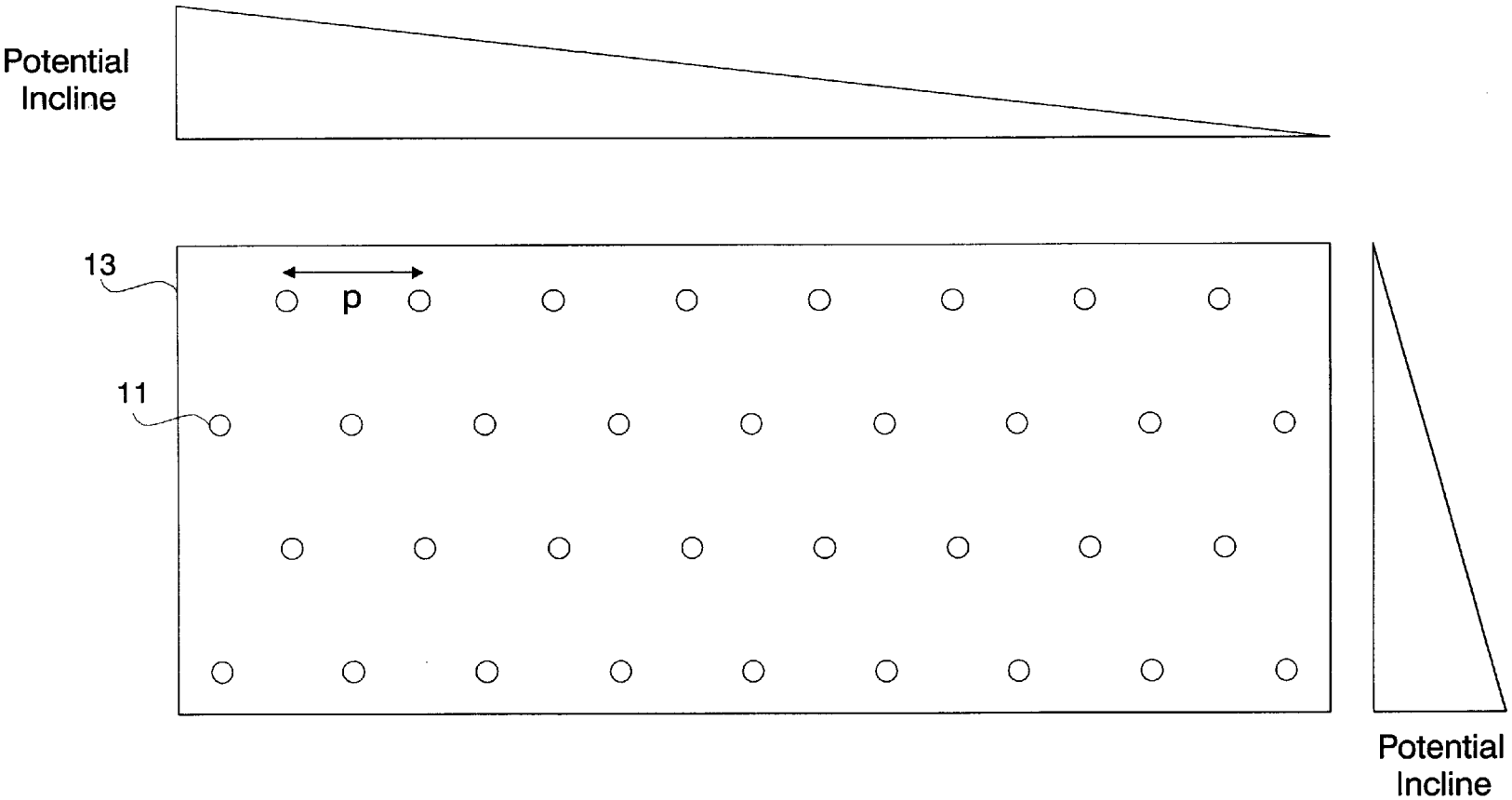
FIG. 5 PRIOR ART
FIG. 5 is a plan view showing the application of carbon embedment to a factory or a farm.
Figure 6:
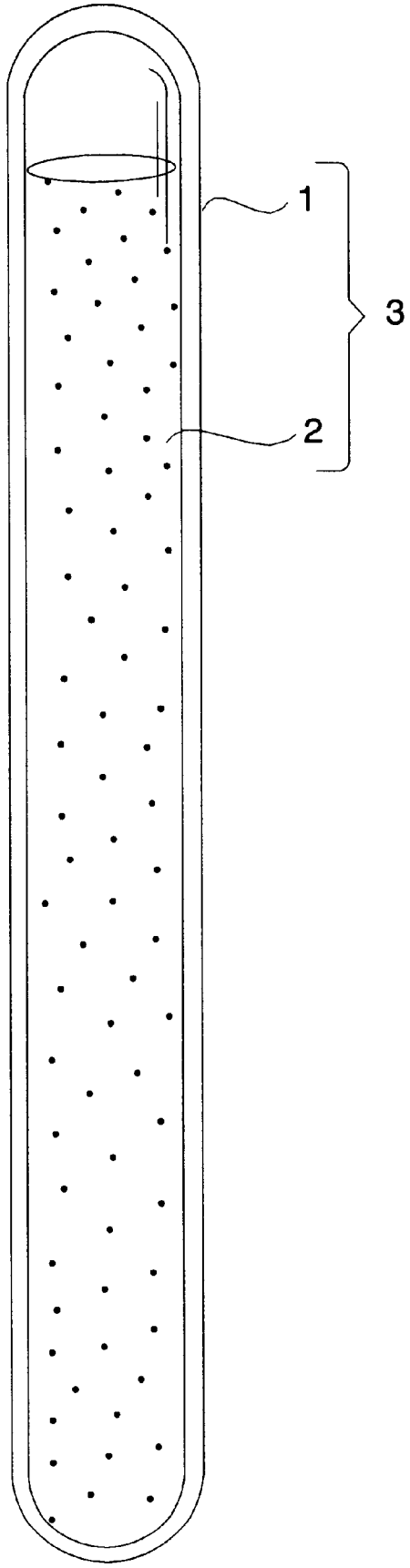
FIG. 6 is a schematic view showing an electrification preventing implement of the present invention.

FIG. 6 is a schematic view showing an electrification preventing implement of the present invention. For instance, in a reinforced glass tube made of Pyrex (made by IWAKI GLASS) 1,500 TO 600 g of powder of, for example, silicon (Si) 2 is tightly sealed. The silicon 2 is first placed in a negatively-ionized quart crucible for a predetermined time to be negatively charged. An appropriate hole is dug nearly in the center of a house, a factory or a farm. One electrification preventing implement 3 is embedded in an upright position in the hole.

Figure 7:
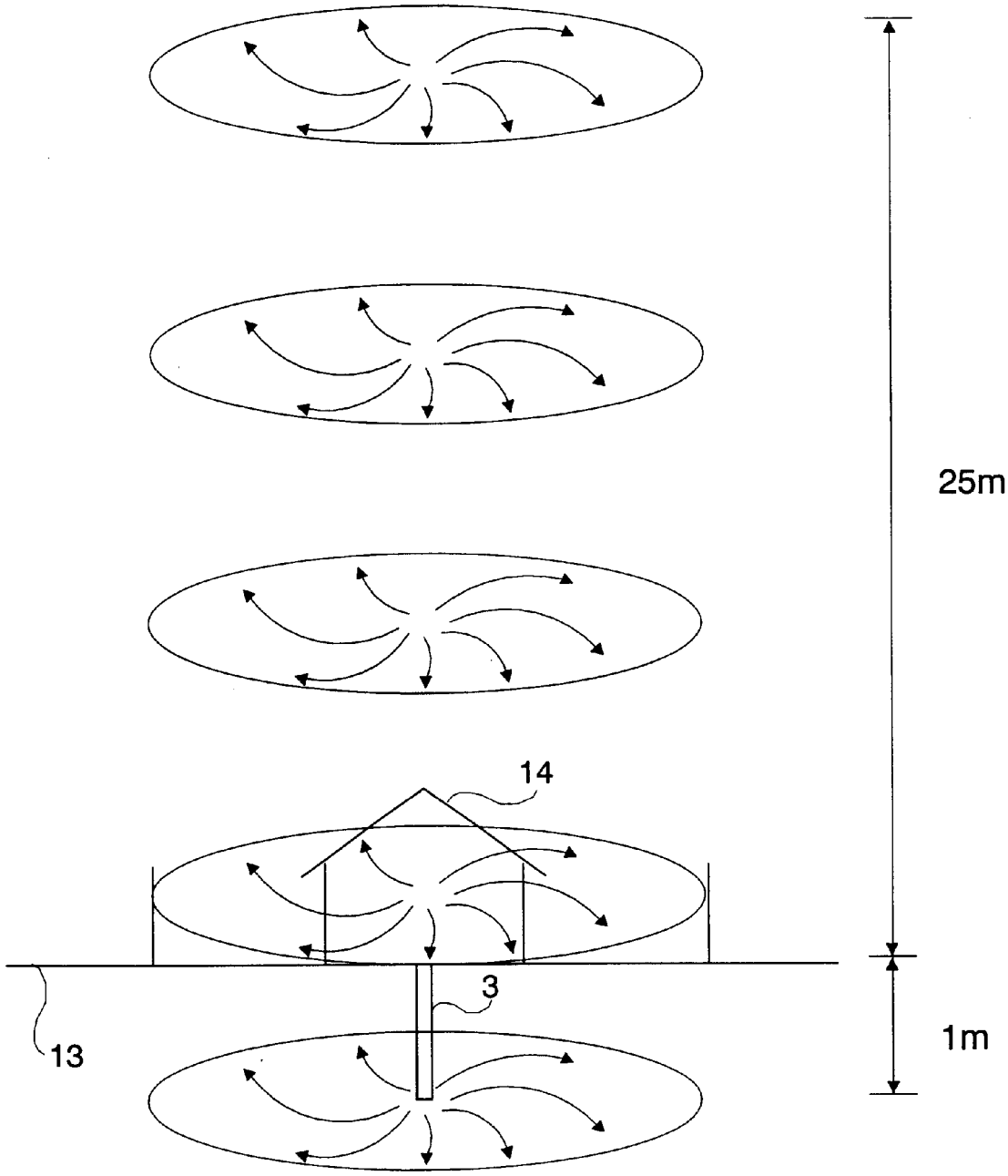
FIG. 7 is a side view of a house in which the electrification preventing implement is embedded and the vicinity thereof.
Figure 8:
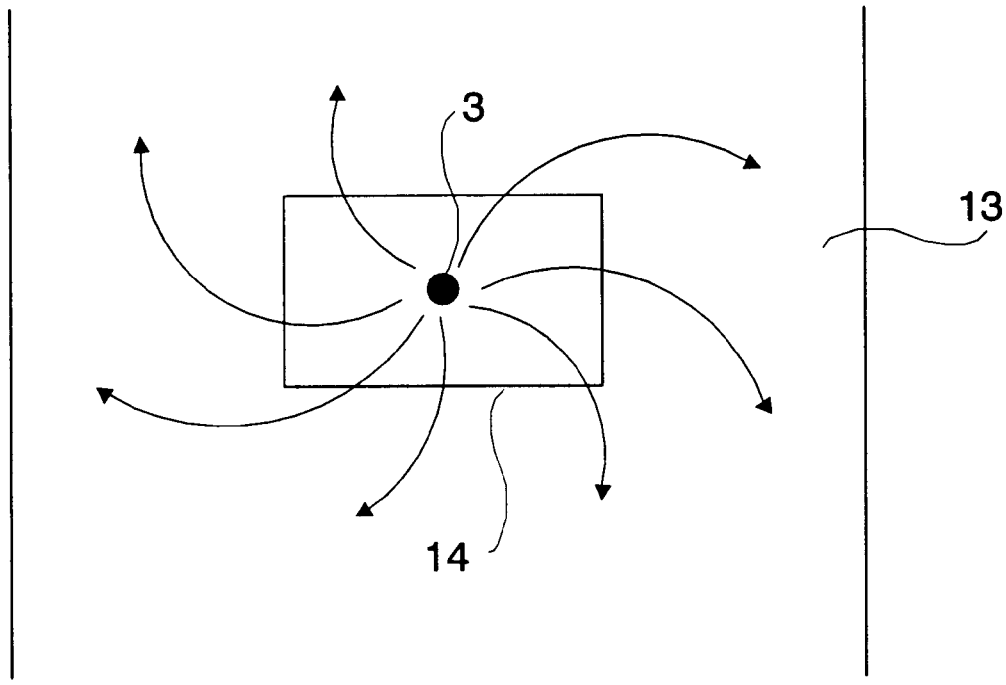
FIG. 8 is a plan view of a house in which the electrification preventing implement is embedded and the vicinity thereof.

FIG. 7 is a side view of the house in which the electrification preventing implement 3 is embedded and its vicinity. FIG. 8 is a plan view of the house and its vicinity. The earth current measured on land at a height of 100 m above sea level was 20 to 40 $\mu$A. The static electricity was reduced to about 15 $\mu$A by the embedment of the electrification preventing implement 3. This is because the stray current on the ground surface and its vicinity was allowed to flow easily and the residing static electricity was discharged to be eliminated. The embedment of the implement 3 reduces the intensity of current flowing in a human body, alleviating the above-mentioned hindrances to men's health and morbid symptoms.

The eddies shown in FIGS. 7 and 8 indicate the direction of electric current in the earth. Negative static electricity from the silicon 2 acts to increase concentration of negative ions in the house and its vicinity.

It is generally known that the negative ions are effective in recovery from fatigue, cleaning of blood, and so forth. Air cleaning implements bedding (futon, pillows), and so forth having such function have been widely used. With the electrification preventing implement 3 embedded, negative ions activated hydrogen molecules. Thus, a comfortable living space in which the air is cleaned can be obtained. As to human bodies, both physical or mental effects can be appreciated.

For example, a person feels agile, becomes more patient, and so forth.

According to the method of the present invention, a hole for embedding only one electrification preventing implement 3 is merely dug. The method can be carried out more easily as compared with conventional embedment of carbon. As the implement to be embedded is one glass tube only, it can easily be transported.

In a fish feed factory, filled with bad smells, the smells disappeared immediately after the electrification preventing implement 3 was embedded. When the implement 3 was applied to a farm, plants were activated and the growth rate was enhanced.

It is verified that the effects of the electrification preventing implement 3, which has a length of 1 m, extends to the space about 25 m above the ground. In the case of a length of 1.5 m, the effects extend to the space above 50 m above the ground. Thus, the length and the diameter of the reinforced glass tube 1, and the amount of the silicon 2 can be appropriately selected, depending on lands and buildings. The effects are long-lasting. Though Si is used in the above embodiments, SiOx may be used. With component of SiOx, good effects can be obtained when x is a number satisfying $1.00 \leqq x \leqq 1.95$, but almost no effect can be obtained in the case where x=2.00. Higher electrification preventing effects can be obtained as the degree of negative electrification is higher. Further, although only one electrification preventing implement is embedded in the above-described embodiment, a plurality of implements may be embedded for obtaining the effects in a larger area, or for obtaining greater effects.

Figure 9:
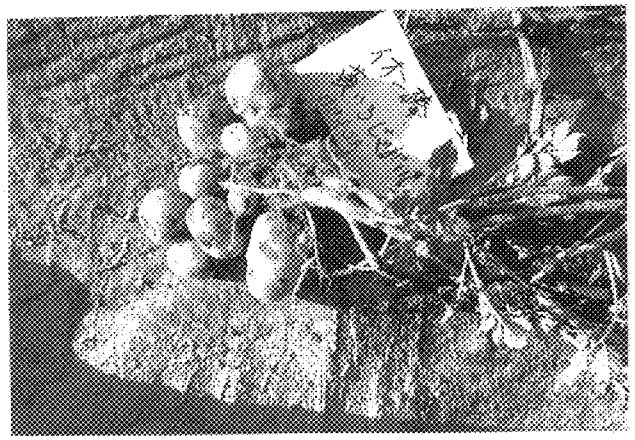
FIGS. 9 and 10 are photographs showing the growth of potato plants raised in the in a vicinity where an implement embodying the invention was embedded, to reduce stray current.
Figure 10:
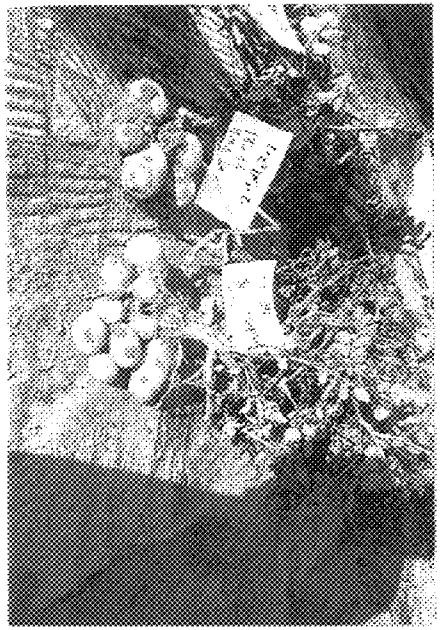
Figure 11:
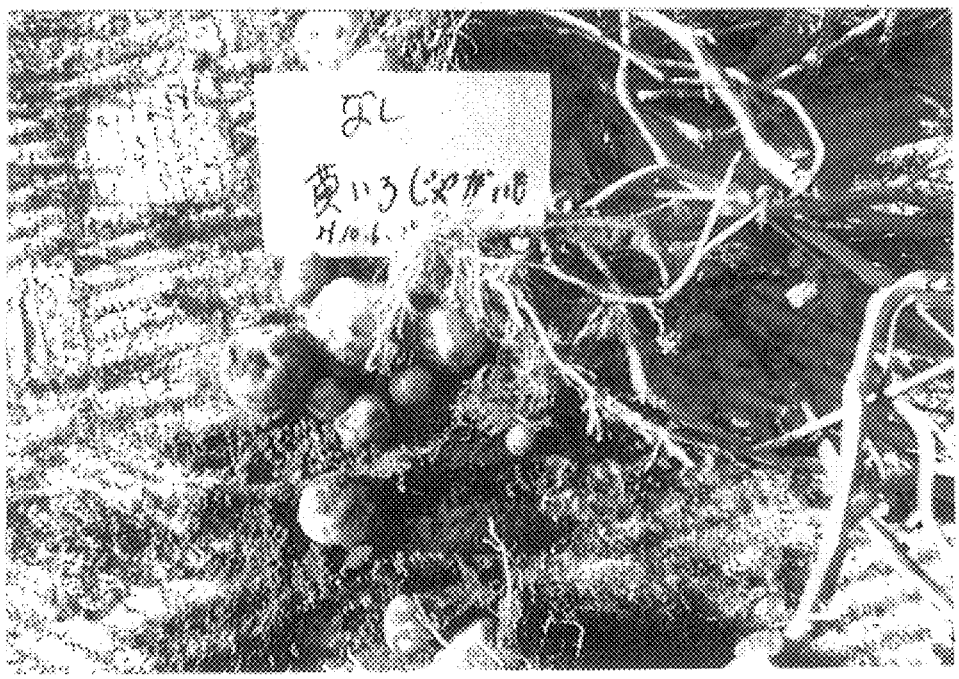
FIGS. 11 and 12 are photographs showing the growth of potato plants in normal ground.
Figure 12:
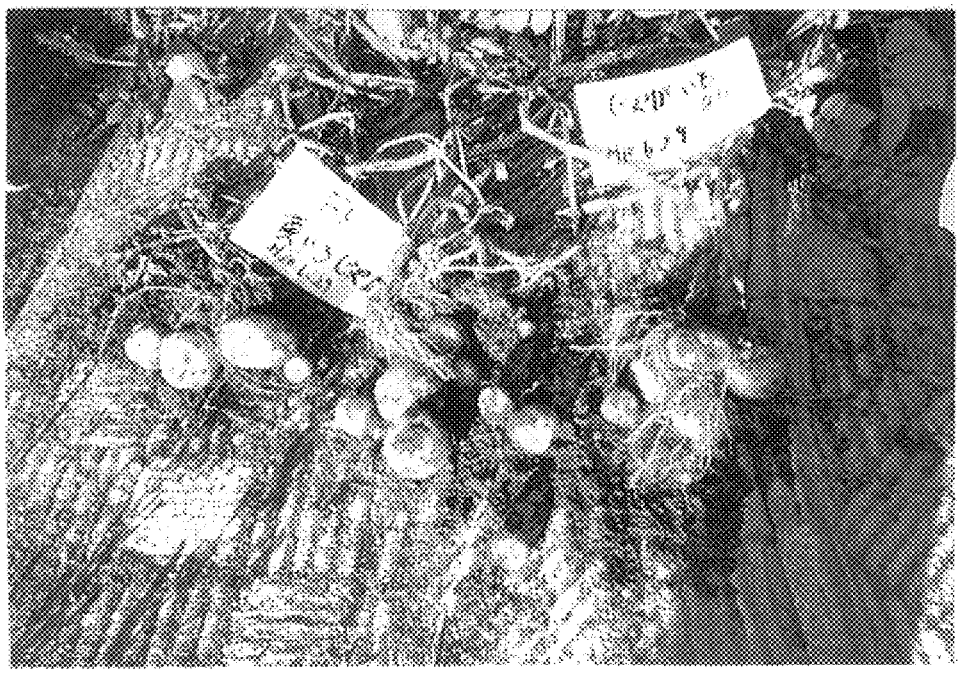

FIGS. 9 and 10 are photographs showing the growth of potato plants raised in the ground where the glass container of the invention was embedded to reduce stray current. FIGS. 11 and 12 are photographs showing the growth of potatoes plants in normal ground.

With respect to the potato plants shown in FIGS. 9 and 10, the growing conditions were as follows:

A glass container of cylindrical shape of a size of 3 cm outer diameter, glass thickness of 4 mm and length of 1.0 meter was embedded with the axis of the container vertical in each of the four corners and center (a total of five containers) of a plot of farmland of 20 acres of square shape. The top of each container was embedded at a depth of about 1.5 meters from the ground surface.

Each glass container contained 450 g of ionized granular Si. The diameter of the granules was from 0.2 mm–2 mm. The Si was previously placed in a minus-ionized (negatively, electrically charged) quartz crucible so that granules were, what I designate as, "ionized". The plants in the 20 acre plot with the containers were grown in the normal manner relying mostly on rain water. Extra water was supplied when the plants were budding.

A handful of fertilizer (50–70 g) was supplied to each potato plant in the usual manner twice in the course of growth, specifically at a time when the bud became about 10–15 cm and at a time when the bud became about 20–25 cm.

The fertilizer is a mixture of the following:

| | | |
|---|---|---|
| 20% | Organic fertilizer: | |
| | phosphoric acid | 6% |
| | potash | 7% |
| | nitrogen | 8% |
| | soybean meal/rapeseed meal | 79% |
| 30% | Poultry manure | |
| 50% | Barnyard manure (remains of a meal, etc.) | |

The potato plants of the photographs of FIGS. 11 and 12 were planted and grown in a plot of land adjacent to the plants of FIGS. 9 and 10, at the same time and under the same conditions.

The plants in the plot with the glass containers and in the normal ground were planted and harvested at the times. The water and fertilizer were supplied in the same amounts to the plants raised in the ground where the glass containers were embedded as the plants raised in the normal ground.

The plants raised in the ground where the glass containers were embedded were superior to those raised in the normal ground in the following respects:

The size of potatoes is uniform;

The cluster has a good shape;

The taste of potatoes is natural and good.

The first two features are shown in the photographs. The last feature (the taste) was based on a subjective analysis by the inventor.

As described above, the electrification preventing implement and the electrification preventing method have excellent effects that allow stray current above and under ground to flow easily by vertically embedding a glass tube with Si sealed therein, thereby preventing electrification that affects human bodies, animals and plants and objects.

Although preferred embodiments of the invention have been disclosed for illustrative purposes, those skilled in the art will appreciate that many additions, modifications and substitutions are possible, without departing from the scope and spirit of the invention as defined by the accompanying claims.

What is claimed:

1. An apparatus for treating an environment to reduce the positive static electricity charge caused by stray electric current in a body adjacent the environment, comprising a sealed glass container for placement in the body, said container containing a quantity of Si or $SiO_x$ ($0<x<2$) or a mixture thereof in granular or powder form that is negatively electrically charged.

2. An method for treating an environment to reduce the positive static electricity charge caused by stray electric current in a body adjacent the environment, said method making use of a sealed glass container containing a quantity of Si or SiOx ($0<x<2$) or a mixture thereof in granular or powder form that is negatively electrically charged, said method comprising the step of embedding the container in the body.

3. The method claim 2 wherein said container is placed in an upright position.

4. The method claim 2 wherein said container is embedded in the ground.

5. The method of claim 2 wherein said container is embedded in an upright position.

6. The method of claim 5 wherein the container is embedded in the ground.

7. The method of claim 2 wherein the container is placed in the ground.

* * * * *